US008733059B1

(12) United States Patent
Hamra

(10) Patent No.: US 8,733,059 B1
(45) Date of Patent: May 27, 2014

(54) PLANK ASSEMBLY FOR USE IN AN ATTIC

(71) Applicant: Mark S. Hamra, Tulsa, OK (US)

(72) Inventor: Mark S. Hamra, Tulsa, OK (US)

( * ) Notice: Subject to any disclaimer, the term of this patent is extended or adjusted under 35 U.S.C. 154(b) by 0 days.

(21) Appl. No.: 13/918,009

(22) Filed: Jun. 14, 2013

(51) Int. Cl.
*E04B 5/02* (2006.01)

(52) U.S. Cl.
USPC ..... 52/650.3; 52/749.1

(58) Field of Classification Search
CPC ..... E04B 5/12; E04B 5/02; E04B 1/003
USPC ..... 52/650.3, 749.1
See application file for complete search history.

(56) References Cited

U.S. PATENT DOCUMENTS

| | | | | | |
|---|---|---|---|---|---|
| 2,964,807 | A * | 12/1960 | Kennedy | 52/696 |
| 3,686,804 | A | 8/1972 | Browne | |
| 4,051,639 | A * | 10/1977 | Lombardi et al. | 52/64 |
| 5,412,920 | A * | 5/1995 | Hess | 52/712 |
| 5,632,123 | A * | 5/1997 | Erwin | 52/177 |
| D539,933 | S | 4/2007 | Fischer | |
| 7,591,105 | B2 | 9/2009 | Balser | |
| 7,861,467 | B2 * | 1/2011 | Rosten et al. | 52/95 |
| 8,096,087 | B2 | 1/2012 | Wainland | |
| 8,161,690 | B1 | 4/2012 | Borne et al. | |
| 8,572,900 | B1 * | 11/2013 | Potts | 52/19 |
| 2001/0025465 | A1 * | 10/2001 | Osfolk | 52/650.3 |
| 2007/0028550 | A1 | 2/2007 | Clapper | |
| 2010/0133216 | A1 | 6/2010 | Lanza-Brache et al. | |

* cited by examiner

*Primary Examiner* — Andrew J Triggs

(57) ABSTRACT

A plank assembly for use in an attic safely supports an individual on an attic surface whether moving across or remaining stationary on the surface. The assembly includes a plank having a top surface opposite a bottom surface and a perimeter edge extending between the top and bottom surfaces. The plank is configured for coupling to a pair of joists supporting an attic when a top side of the joists abuts the bottom surface of the plank. A pair of extensions is coupled to the plank. Each of the extensions is coupled to opposite ends of the perimeter edge. Each of the extensions is slanted downwardly relative to the top surface of the plank. An inner side of each of the extensions is configured for positioning above an outer side of an associated one of the joists.

13 Claims, 4 Drawing Sheets

PLANK ASSEMBLY FOR USE IN AN ATTIC

BACKGROUND OF THE DISCLOSURE

Field of the Disclosure

The disclosure relates to plank assemblies and more particularly pertains to a new plank assembly for safely supporting an individual on an attic surface whether moving across or remaining stationary on the surface.

SUMMARY OF THE DISCLOSURE

An embodiment of the disclosure meets the needs presented above by generally comprising a plank having a top surface opposite a bottom surface and a perimeter edge extending between the top and bottom surfaces. The plank is configured for coupling to a pair of joists supporting a ceiling surface below an attic when a top side of the joists abuts the bottom surface of the plank. A pair of extensions is coupled to the plank. Each of the extensions is coupled to opposite ends of the perimeter edge. Each of the extensions is slanted downwardly relative to the top surface of the plank. An inner side of each of the extensions is configured for positioning above an outer side of an associated one of the joists.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
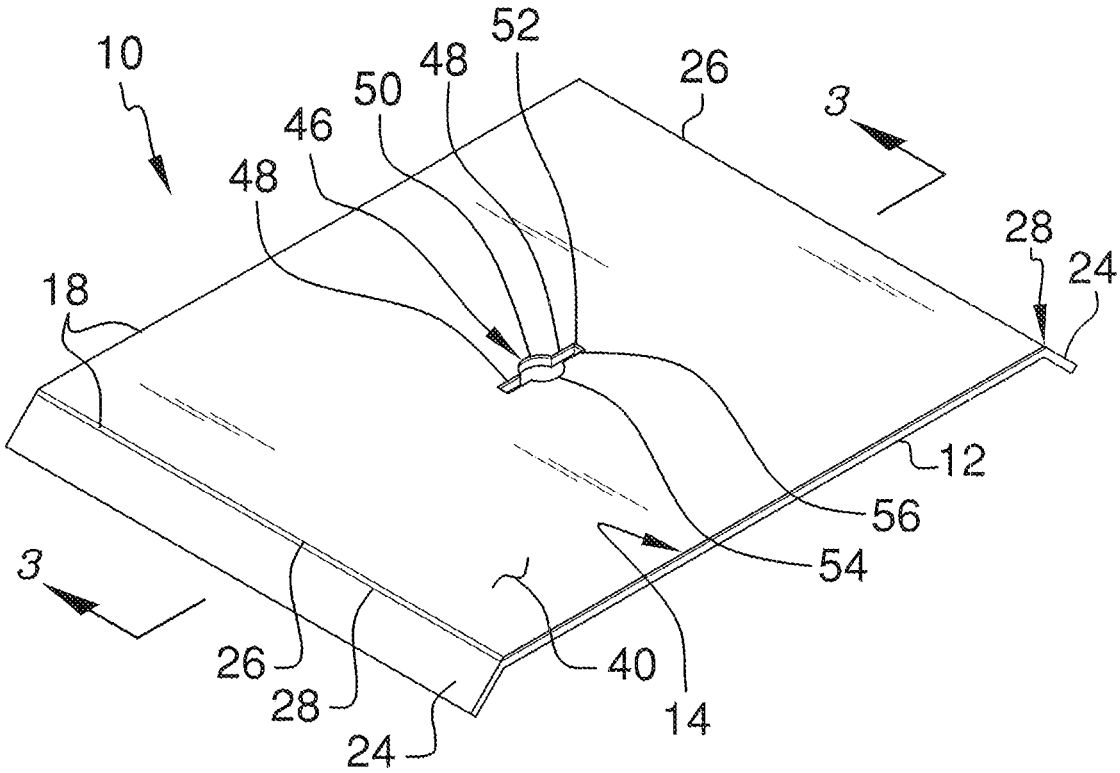
FIG. 1 is a top front side perspective view of a plank assembly for use in an attic according to an embodiment of the disclosure.
Figure 2:
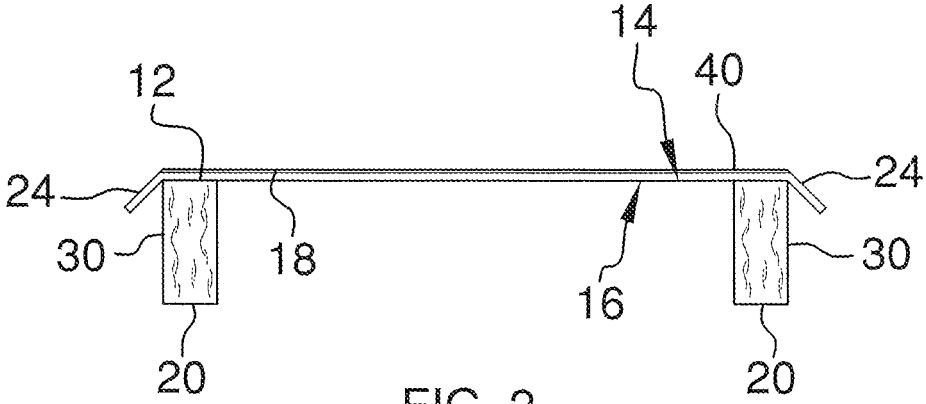
FIG. 2 is a front view of an embodiment of the disclosure in use.
Figure 3:
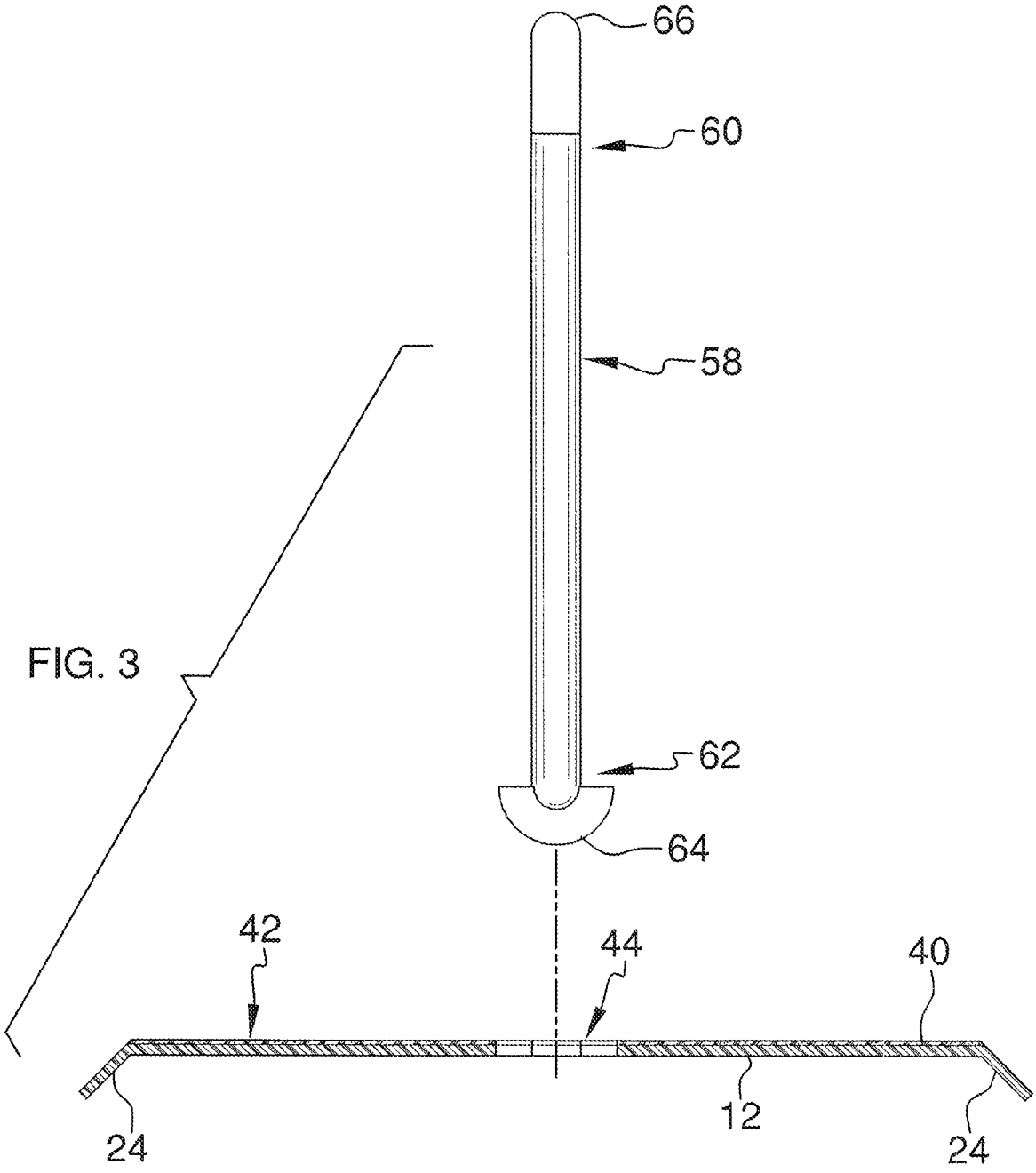
FIG. 3 is a cross-sectional view of an embodiment of the disclosure taken along line 3-3 of FIG. 1.
Figure 4:
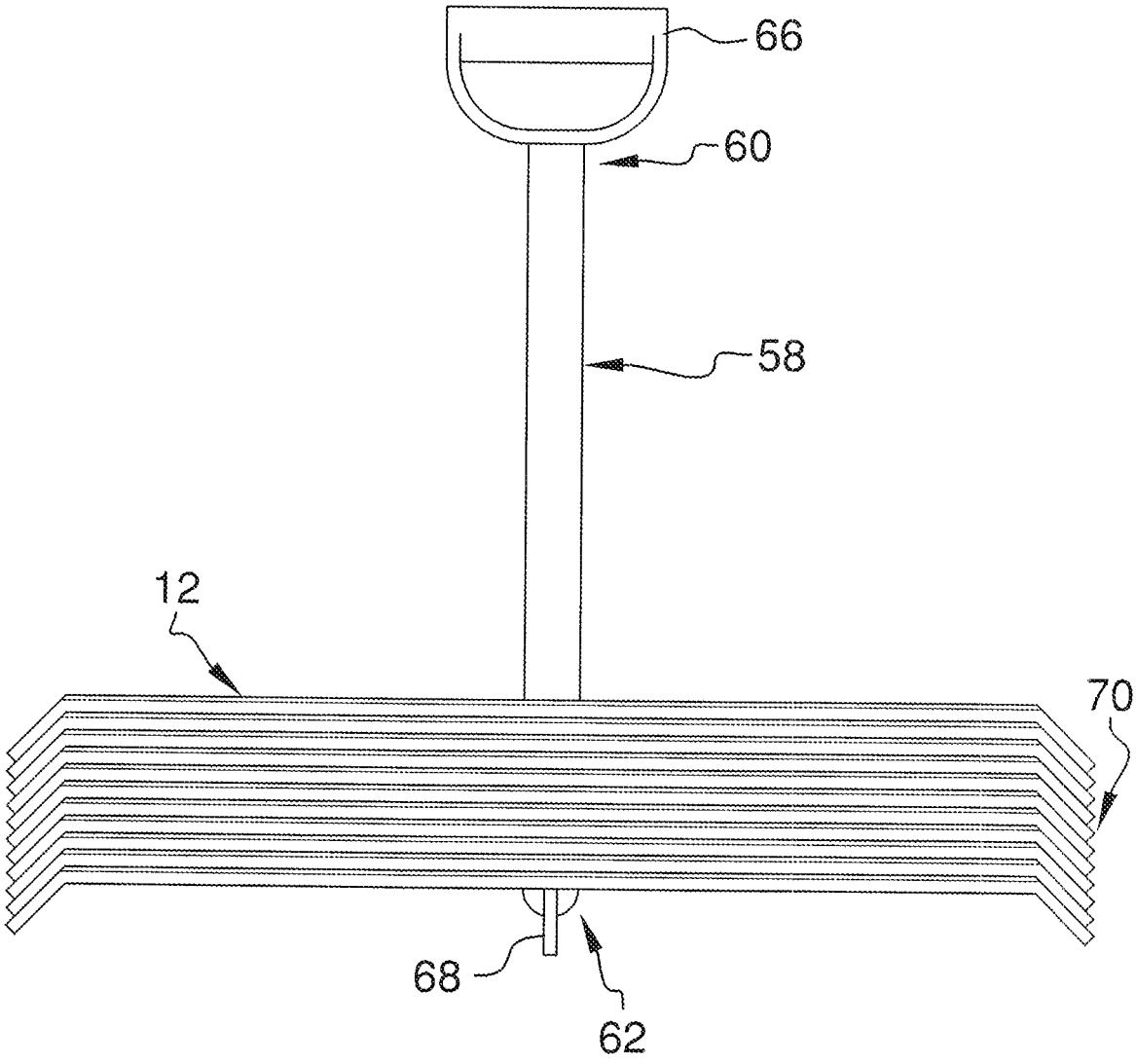
FIG. 4 is a front view of a lifting device and a plurality of planks of an embodiment of the disclosure.
Figure 5:
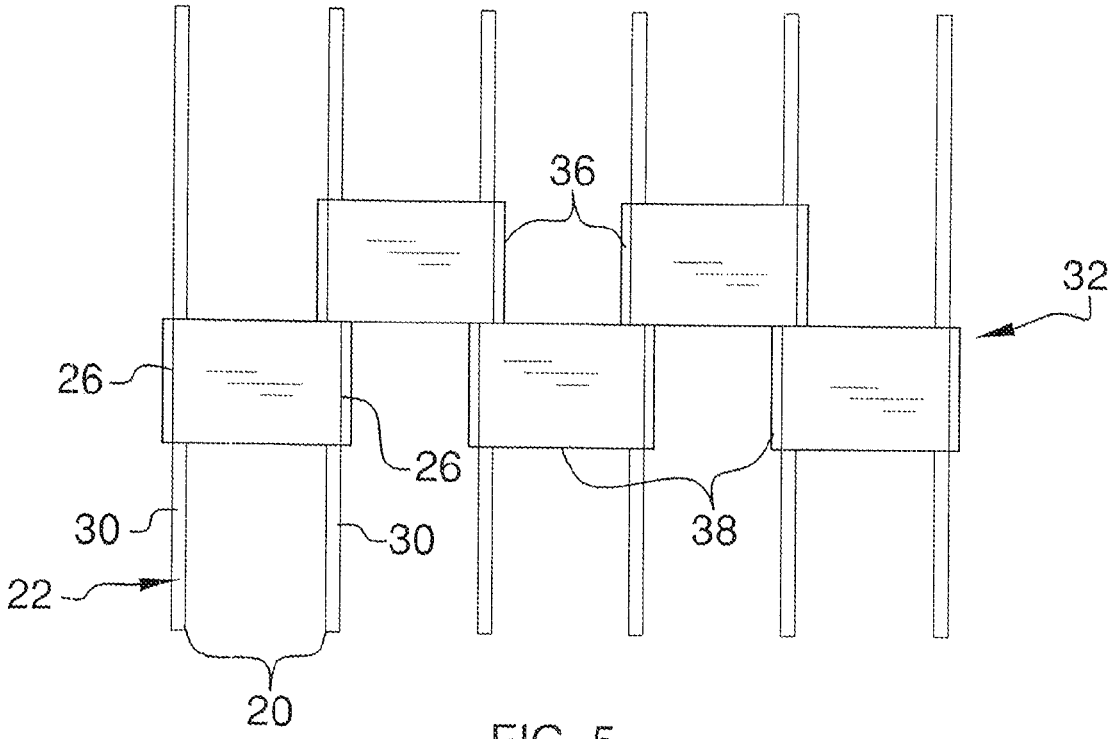
FIG. 5 is an in-use top view of a plurality of planks of an embodiment of the disclosure permitting perpendicular travel of a user.
Figure 6:
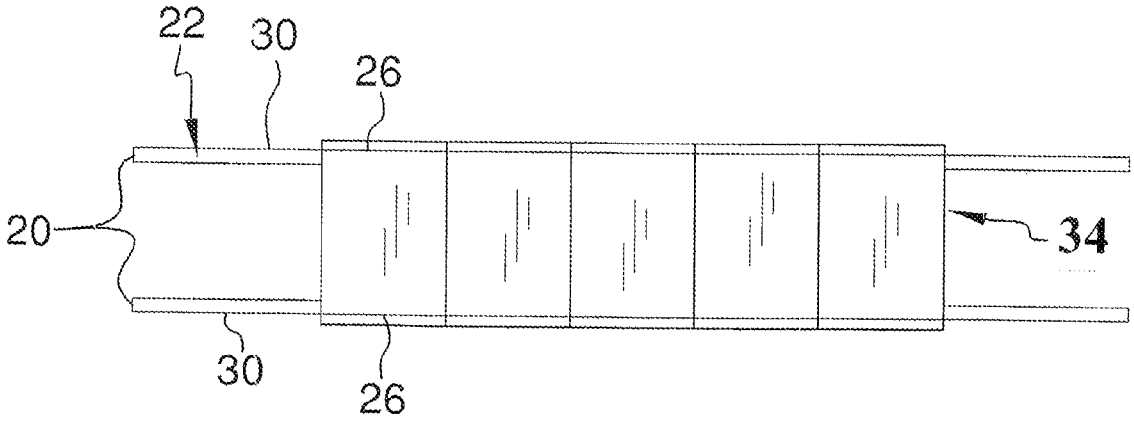
FIG. 6 is an in-use top view of a plurality of planks of an embodiment of the disclosure permitting parallel travel of a user.

With reference now to the drawings, and in particular to FIGS. 1 through 6 thereof, a new plank assembly embodying the principles and concepts of an embodiment of the disclosure and generally designated by the reference numeral 10 will be described.

As best illustrated in FIGS. 1 through 6, the plank assembly for use in an attic 10 generally comprises a plurality of planks 12. Each of the planks 12 has a top surface 14 opposite a bottom surface 16 and a perimeter edge 18 extending between the top 14 and bottom 16 surfaces. Each of the planks 12 is configured for coupling to a pair of joists 20 supporting a ceiling surface below an attic when a top side 22 of the joists 20 abuts the bottom surface 16 of each of the planks 12. Each of the planks 12 is preferably lightweight and portable. The planks 12 are preferably comprised of a durable material, such as polypropylene or the like. A pair of extensions 24 is coupled to each of the planks 12. Each of the extensions 24 of an associated one of the planks 12 is coupled to opposite ends 26 of the perimeter edge 18. Each of the extensions 24 is slanted downwardly relative to the top surface 14 of the associated one of the planks 12. An inner side 28 of each of the extensions 24 is configured for positioning above an outer side 30 of an associated one of the joists 20.

The planks 12 are positionable in one of a first configuration 32 and a second configuration 34. The first configuration 32 comprises a first row of planks 36 and a second row of planks 38. The first row of planks 36 is spaced and aligned. Likewise, the second row of planks 38 is spaced and aligned. The planks 12 of the first row 36 are positioned between adjacent planks 12 of the second row 38 wherein the first configuration 32 permits a user to travel perpendicularly on the planks 12 above the ceiling surface. The extensions 24 of the second row of planks 38 are offset from adjacently positioned extensions 24 of the first row of planks 36. The second configuration 34 of the planks 12 comprises the extensions 24 of each of the planks 12 being aligned with the extensions 24 of adjacently positioned planks 12 wherein the planks 12 are configured for positioning above a same pair of joists 20 to permit the user to travel parallel on the planks 12 above the ceiling surface. The direction of travel provided by each of the first 32 and second 34 configurations is determined in relation to a longitudinal axis extending through each of the planks 12. Thus, the first configuration 32 permits perpendicular travel relative to the longitudinal axis extending through each of the planks 12, and the second configuration 34 permits parallel travel relative to the longitudinal axis extending through each of the planks 12.

A pad 40 is preferably coupled to each of the planks 12. The pads 40 extend across the top surface 14 of each of the planks 12. The pads 12 may be comprised of a resiliently compressible material 42, such as rubber or the like, wherein the pads 12 are configured for preventing a user from slipping off the planks 12 while also providing electrical insulation for wiring in the attic.

An opening 44 may extend into each of the planks 12. The openings 44 extend from the top surface 14 to the bottom surface 16 of each of the planks 12. The openings 44 preferably have an annular center 46 and a pair of straight portions 48 extending outwardly from the center 46. A first edge 50 of the center 46 extends outwardly from a first edge 52 of the straight portions 48. A second edge 54 of the center 46 extends outwardly from a second edge 56 of the straight portions 48. The opening 44 may be centrally positioned in each of the top surfaces 14.

An elongated lifting device 58 has a top portion 60 positioned opposite a bottom portion 62. The bottom portion 62 may have an arcuate bottom end 64. The bottom portion 62 is extendable through the openings 44 of the planks 12 such that a plurality of the planks 12 are stackable for transport when the bottom end 64 of the lifting device 58 is aligned with and extends through the openings 44 of each of the planks 12 to be transported such that each of the planks 12 abut an adjacently positioned one of the planks 12. The lifting device 58 may further comprise a handle 66 and a latch 68. The handle 66 is coupled to and extends outwardly from the top portion 60 wherein the handle 66 is configured for grasping by the user. The latch 68 is coupled to the bottom portion 62 wherein the latch 68 is configured for holding the planks 12 in a carrying position 70. In this manner, the planks 12 are easily transported up into an attic entrance. The lifting device 58 is preferably constructed from plastic or similar durable material. The lifting device 58 is configured to hold between approximately ten and fifteen planks 12 at one time.

Each of the planks 12 has a width between approximately 30.0 centimeters and 80.0 centimeters, a length between approximately 15.0 centimeters and 60.0 centimeters, and a height between approximately 1.0 centimeter and 10.0 centimeters.

In use, as stated above and shown in the Figures, the planks 12 are positioned over the joists 20 of an attic to provide a stable surface upon which a user can sit, kneel, lie, stand, or walk across. In this manner, the planks 12 prevent the user from falling through the attic and permit the user to safely and effectively perform tasks in the attic. The pads 40 help keep a user positioned on the planks 12 while also providing electrical insulation to wiring in the attic. The planks 12 are positioned in the first configuration 32 to accommodate the user's perpendicular travel in the attic. The planks 12 are positioned in the second configuration 34 to permit the user to travel in a parallel fashion in the attic. The lifting device 58 is inserted through the openings 44 in the planks 12 in order to easily transport a plurality of planks 12 from one area to another. The latch 68 is used to secure the planks 12 in the carrying position 70.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A plank assembly for use in an attic comprising:

a plank having a top surface opposite a bottom surface and a perimeter edge extending between said top and bottom surfaces, said plank being configured for coupling to a pair of joists supporting an attic when a top side of said joists abuts said bottom surface of said plank, said plank being one of a plurality of said planks;

each of said planks having an opening extending therein, each of said openings extending from said top surface to said bottom surface of an associated one of said planks; and an elongated lifting device having a top portion opposite a bottom portion, said bottom portion being extendable through said openings such that a plurality of said planks are stackable for transport when a bottom end of said lifting device is aligned with and extends through said openings such that each of said planks to be transported abut an adjacently positioned one of said planks.

2. The assembly of claim 1, further comprising:

each of said planks having a respective longitudinal axis extending therethrough; and said planks being positionable in a first configuration, said first configuration comprising a first row of planks and a second row of planks, said first row of planks being spaced and aligned, said second row of planks being spaced and aligned, said planks of said first row being positioned between adjacent said planks of said second row wherein said first configuration permits a user to travel perpendicularly on said planks relative to said longitudinal axis extending through each said plank.

3. The assembly of claim 1, further comprising a plurality of pairs of extensions, each of said pairs of extensions being coupled to an associated one of said planks, each said extension of said associated one of said planks being coupled to opposite ends of said perimeter edge, each of said extensions being slanted downwardly relative to said top surface of said associated one of said planks, an inner side of each of said extensions being configured for positioning above an outer side of an associated one of the joists.

4. The assembly of claim 3, further comprising:

each of said planks having a respective longitudinal axis extending therethrough; and said planks being positionable in a second configuration, said second configuration of said planks comprising said extensions of said planks being aligned with said extensions of adjacently positioned said planks wherein said planks are configured for positioning above a same pair of joists to permit the user to travel parallel on said planks relative to said longitudinal axis extending through each said plank.

5. The assembly of claim 2, further comprising:

a plurality of pairs of extensions, each of said pairs of extensions being coupled to an associated one of said planks, each said extension of said associated one of said planks being coupled to opposite ends of said perimeter edge; and said extensions of said second row of planks being offset from adjacently positioned said extensions of said first row of planks.

6. The assembly of claim 1, further comprising a pad coupled to each of said planks, said pads extending across said top surface of each said plank.

7. The assembly of claim 6, further comprising said pads being comprised of a resiliently compressible material wherein said pads are configured for preventing a user from slipping off said planks and providing electrical insulation for wiring in the attic.

8. The assembly of claim 1, further comprising said openings having an annular center and a pair of straight portions extending outwardly from said center, a first edge of said center extending outwardly from a first edge of said straight portions, a second edge of said center extending outwardly from a second edge of said straight portions.

9. The assembly of claim 1, further comprising said openings being centrally positioned in each of said top surfaces.

10. The assembly of claim 1, further comprising said bottom end of said lifting device being arcuate.

11. The assembly of claim 1, further comprising a handle coupled to and extending outwardly from said top portion wherein said handle is configured for grasping by the user.

12. The assembly of claim 1, further comprising a latch coupled to said bottom portion wherein said latch is configured for holding said planks in a carrying position.

13. A plank assembly for use in an attic comprising:

a plurality of planks, each of said planks having a top surface opposite a bottom surface and a perimeter edge extending between said top and bottom surfaces, each of said planks having a respective longitudinal axis extending therethrough, each of said planks being configured for coupling to a pair of joists supporting an attic when a top side of said joists abuts said bottom surface of each of said planks, said planks being positionable in one of a first configuration and a second configuration, said first configuration comprising a first row of planks and a second row of planks, said first row of planks being spaced and aligned, said second row of planks being spaced and aligned, said planks of said first row being positioned between adjacent said planks of said second row wherein said first configuration permits a user to travel perpendicularly on said planks relative to said longitudinal axis extending through each said plank;

a plurality of pairs of extensions, each of said pairs of extensions being coupled to an associated one of said planks, each said extension of said associated one of said planks being coupled to opposite ends of said perimeter edge, each of said extensions being slanted downwardly relative to said top surface of said associated one of said planks, an inner side of each of said extensions being configured for positioning above an outer side of an associated one of the joists, said second configuration of said planks comprising said extensions of said planks being aligned with said extensions of adjacently positioned said planks wherein said planks are configured for positioning above a same pair of joists to permit the user to travel parallel on said planks relative to said longitudinal axis extending through each said plank, said extensions of said second row of planks being offset from adjacently positioned said extensions of said first row of planks;

a pad coupled to each of said planks, said pads extending across said top surface of each said plank, said pads being comprised of a resiliently compressible material wherein said pads are configured for preventing a user from slipping off said planks and providing electrical insulation for wiring in the attic;

an opening extending into each of said planks, said openings extending from said top surface to said bottom surface of each said plank, said openings having an annular center and a pair of straight portions extending outwardly from said center, a first edge of said center extending outwardly from a first edge of said straight portions, a second edge of said center extending outwardly from a second edge of said straight portions, said openings being centrally positioned in each of said top surfaces; and an elongated lifting device having a top portion positioned opposite a bottom portion, said bottom portion having an arcuate bottom end, said bottom portion being extendable through said openings of said planks such that a plurality of said planks are stackable for transport when said bottom end of said lifting device is aligned with and extends through said openings of each of said planks to be transported such that each of said planks abut an adjacently positioned one of said planks, said lifting device further comprising a handle coupled to and extending outwardly from said top portion wherein said handle is configured for grasping by the user, and a latch coupled to said bottom portion wherein said latch is configured for holding said planks in a carrying position.

* * * * *